US011659893B2

(12) United States Patent
McLellan et al.

(10) Patent No.: US 11,659,893 B2
(45) **Date of Patent: *May 30, 2023**

(54) SHOE WITH KNIT UPPER PORTION

(71) Applicant: Allbirds, Inc., San Francisco, CA (US)

(72) Inventors: Jamie McLellan, Sausalito, CA (US); Thomas Jad Finck, San Francisco, CA (US); Lisa Halbower-Fenton, Scituate, MA (US); James Romero, San Francisco, CA (US); Uidong Cho, Busan (KR); Joseph Zwillinger, Mill Valley, CA (US); Timothy Brown, San Francisco, CA (US)

(73) Assignee: ALLBIRDS, INC., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/341,235

(22) Filed: Jun. 7, 2021

(65) Prior Publication Data

US 2022/0000218 A1 Jan. 6, 2022

Related U.S. Application Data

(63) Continuation of application No. 16/354,118, filed on Mar. 14, 2019, now Pat. No. 11,026,477.

(51) Int. Cl.

| | |
|---|---|
| ***A43B 23/02*** | (2006.01) |
| ***A43B 1/04*** | (2022.01) |
| ***A43B 1/00*** | (2006.01) |

(52) U.S. Cl.

CPC ..... *A43B 23/024* (2013.01); *A43B 1/0063* (2013.01); *A43B 1/04* (2013.01); *A43B 23/027* (2013.01)

(58) Field of Classification Search

CPC . A43B 23/024; A43B 23/0235; A43B 23/026; A43B 23/027; A43B 7/085

See application file for complete search history.

(56) References Cited

U.S. PATENT DOCUMENTS

| | | | | |
|---|---|---|---|---|
| 4,447,967 | A | 5/1984 | Zaino et al. | |
| 10,085,516 | B2 | 10/2018 | Adami et al. | |
| 11,026,477 | B2 * | 6/2021 | McLellan ..... | A43B 23/0205 |
| 2002/0114959 | A1 | 8/2002 | Kang | |
| 2003/0159312 | A1 | 8/2003 | Farys | |
| 2006/0143767 | A1 | 7/2006 | Yang et al. | |
| 2007/0294920 | A1 | 12/2007 | Baychar et al. | |

(Continued)

*Primary Examiner* — Ted Kavanaugh

(74) *Attorney, Agent, or Firm* — Brownstein Hyatt Farber Schreck, LLP

(57) ABSTRACT

A shoe may include an upper portion constructed from a continuous textile (e.g., a knit textile) that includes multiple regions having different textile properties to improve the performance of the shoe, including durability and comfort. In some cases, the multi-region upper portion may include regions having different thickness and/or flexibility based on a location relative to a wearer's foot to better support the wearer's foot. For example, the multi-region upper portion may include a reinforcement region having a first thickness and a flex region having a second thickness less than the first thickness. As another example, the multi-region upper portion may include a reinforcement region having a first stiffness and a flex region having a second stiffness less than the first stiffness.

19 Claims, 10 Drawing Sheets

(56) References Cited

U.S. PATENT DOCUMENTS

| | | | | |
|---|---|---|---|---|
| 2011/0072686 | A1 | 3/2011 | Chen et al. | |
| 2015/0013187 | A1 | 1/2015 | Taniguchi et al. | |
| 2018/0332920 | A1 | 11/2018 | Burch et al. | |
| 2020/0268107 | A1* | 8/2020 | Fuerst | A43B 23/027 |

* cited by examiner

SHOE WITH KNIT UPPER PORTION

CROSS-REFERENCE TO RELATED APPLICATION(S)

This application is a continuation patent application of U.S. patent application Ser. No. 16/354,118, filed Mar. 14, 2019 and titled "Shoes with Knit Upper Portion," the disclosure of which is hereby incorporated herein by reference in its entirety.

FIELD

Embodiments described herein relate to footwear, and in particular, to shoes having features as described herein.

BACKGROUND

Shoes are widely used for protecting and providing comfort to wearers' feet. Traditional shoes include an upper portion that is formed by attaching multiple separate components together. In some cases, the design of traditional shoes adds complexity to the manufacturing process, for example by requiring multiple steps related to assembly of the upper portion. In some cases, traditional shoes are constructed entirely from synthetic materials, the production and use of which may be harmful to the environment and may prevent the shoes from being recycled.

SUMMARY

Certain embodiments described herein generally relate to, include, or take the form of a shoe comprising a sole and an upper portion. The sole defines a tread surface and a top surface opposite the tread surface. The upper portion is attached to the top surface of the sole and comprises a perimeter, a reinforcement region, and a flex region. The perimeter extends around the upper portion where the upper portion meets the sole. The reinforcement region has a first thickness and defines at least a portion of the perimeter. The flex region is at least partially surrounded by the reinforcement region and has a second thickness less than the first thickness. The upper portion is formed from a continuous textile comprising *eucalyptus* fiber.

Other embodiments described herein may relate to a shoe that includes an upper portion and a tongue. The upper portion defines a gap and includes a first reinforcement region having a first thickness and a second reinforcement region adjacent to the gap and the first reinforcement region. The second reinforcement region has a first stiffness. The upper portion further includes a flex region at least partially surrounded by the first reinforcement region and having a second thickness less than the first thickness and a second stiffness less than the first stiffness. The tongue is attached to the upper portion and configured to be positioned at least partially in the gap defined by the upper portion.

Still other embodiments described herein may relate to a knit upper portion for a shoe comprising a first reinforcement region, a second reinforcement region, and a flex region. The first reinforcement region comprises *eucalyptus* fiber and a thermoplastic material and positioned adjacent to a gap defined by the knit upper portion. The second reinforcement region comprises the *eucalyptus* fiber and the thermoplastic material. At least a part of the second reinforcement region is positioned between the first reinforcement region and a perimeter of the knit upper portion. The flex region comprises the *eucalyptus* fiber and is at least partially surrounded by the second reinforcement region. The knit upper portion is knit as a single, unitary piece.

BRIEF DESCRIPTION OF THE DRAWINGS

Reference will now be made to representative embodiments illustrated in the accompanying figures. It should be understood that the following descriptions are not intended to limit this disclosure to one preferred embodiment. To the contrary, the disclosure provided herein is intended to cover alternatives, modifications, and equivalents as may be included within the spirit and scope of the described embodiments, and as defined by the appended claims.

The use of the same or similar reference numerals in different figures indicates similar, related, or identical items.

Figure 1:
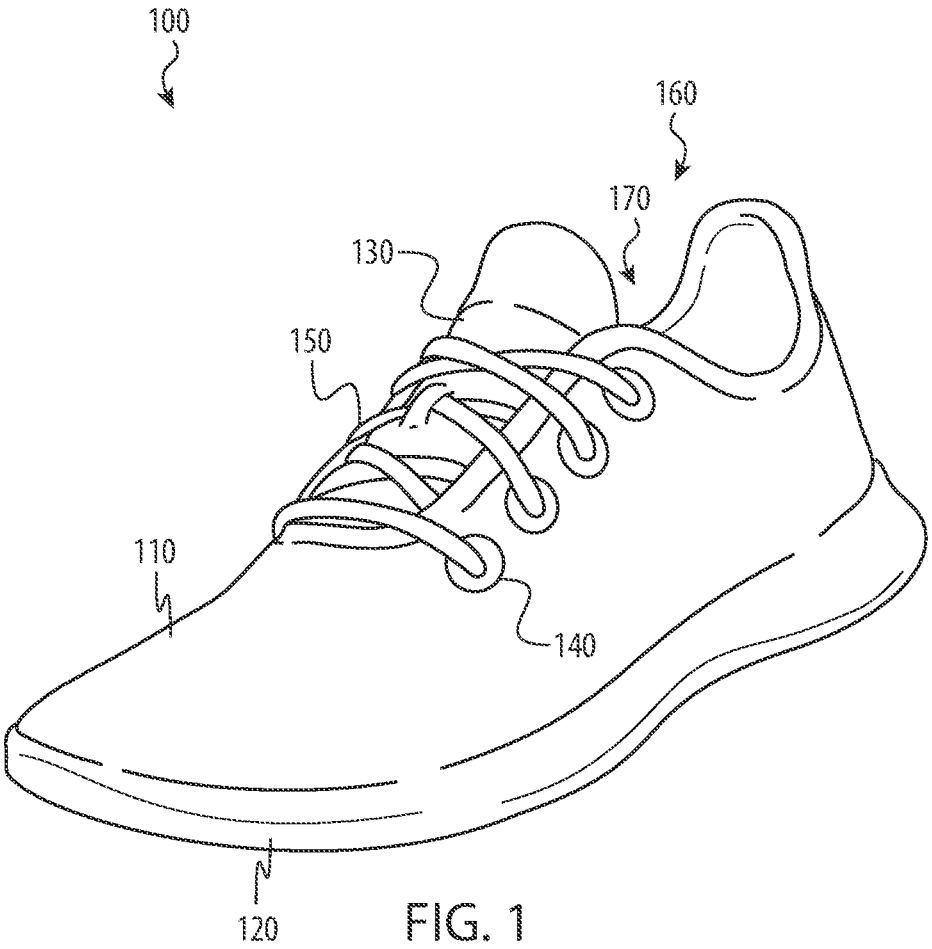
FIG. 1 illustrates an example shoe having a knit textile upper portion.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the claims.

The shoes described herein include various features to improve performance, increase manufacturing efficiency, and provide environmental benefits over traditional shoes. In some cases, a shoe includes an upper portion (e.g., a knit upper portion) constructed from a continuous textile (e.g., a knit continuous textile) that includes multiple regions having different textile properties to improve the performance of the shoe, including durability and comfort.

In some cases, the shoes described herein may be constructed at least partially using bio-based materials. As used herein, the term "bio-based materials" may refer to materials made from substances derived from living or once-living organisms. In some cases, the upper portion includes a bio-based material, such as *eucalyptus* fiber, in yarn used to knit the upper portion. In some cases, other components of the shoes may include bio-based materials. For example, sole of the shoe may include a bio-based foam material made using sugarcane, the insole of the shoe may include a bio-based foam material made using castor bean oil, and eyelets of the shoe may include a bio-based plastic made using corn sugar. In some cases, the shoes described herein may be constructed at least partially using recycled materials. For example, a shoelace of the shoe may be constructed at least partially from recycled plastic bottles.

In various embodiments, the bio-based and recycled materials used in the shoes described herein provides significant environmental benefits over traditional shoes. Using bio-based materials as a substitute for synthetic materials may result in fewer harmful emissions associated with manufacturing the shoe by reducing or eliminating processing of harmful chemicals, such as the petroleum products used to manufacture most synthetic fibers. Similarly, bio-based materials are more ecologically sustainable than many synthetic materials because they are derived from renewable resources (e.g., plant fibers, sugarcane, corn sugar) rather than nonrenewable resources (e.g., petroleum products). *Eucalyptus* fiber is particularly environmentally friendly and sustainable, because *eucalyptus* trees typically do not require irrigation or pesticides, and can be grown in areas that are not suitable for other farming uses. Similarly, using recycled materials instead of new materials reduces waste sent to landfills and incinerators and conserves natural resources, prevents pollution, and saves energy related to the collection and processing of new raw materials.

In addition to using bio-based and recycled materials, the shoes described herein may include various features to make recycling the shoes easier. For example, the shoe may have fewer components to separate from one another as part of the recycling process, for example as a result of upper portion being formed from a continuous textile.

As noted above, in addition to the environmental benefits, the shoes described herein may have improved performance over traditional shoes. In various embodiments, the multi-region upper portion may improve the durability of the shoe, the comfort of the shoe, and/or allow a wearer to comfortably wear the shoe with or without socks. In some cases textile properties and/or textile characteristics, including textile thickness or flexibility, may be varied across different regions to achieve desired shoe performance. For example, in some cases, the upper portion may define one or more reinforcement regions at locations that are more prone to damage or deformation, for example because they are subject to greater forces than other regions. In some cases, the upper portion may define one or more flex regions at locations that are less prone to damage or deformation, for example because they are subject to lesser forces than other regions.

In some cases, a reinforcement region may be configured to be positioned at least partially over a toe of the wearer's foot, such as the wearer's big toe, and the flex region may be configured to be positioned at least partially over another part of the wearer's foot. The wearer's big toe may exert greater forces on the upper portion at the location of the reinforcement region, making this location more prone to damage or deformation. Similarly, a reinforcement region may extend around at least part of a perimeter of the upper portion near the sole. The perimeter of the upper portion near the sole may be more prone to damage or deformation, for example because of proximity to the ground or forces applied to the upper portion by the sole. Additionally, one or more reinforcement regions may be positioned between a gap for the tongue of the shoe and the sole. The area between the gap for the tongue and the sole may be more prone to damage or deformation, for example because of forces applied to the upper portion by the shoelace.

The textile properties for the reinforcement region(s) may be selected to resist damage or deformation to improve the durability of the shoe. For example, a thicker or stiffer reinforcement region of the upper portion may have a higher bursting strength, tensile strength, or abrasive strength compared to other regions. The textile properties for the flex region(s) may be selected to optimize or otherwise enhance comfort, textile feel, and other textile characteristics. For example, a thinner or more flexible flex region may have enhanced breathability and flexibility compared to other regions. The different regions of the upper portion cooperate to provide enhanced performance of the shoe as a whole, including improved durability and comfort.

Some traditional shoes use separate components to achieve desired durability characteristics, such as a flexible material placed between two layers of fabric to achieve a thicker or stiffer upper portion. Providing a thicker region of a continuous textile provides numerous advantages over traditional methods, including increasing manufacturing efficiency by reducing manufacturing steps and eliminating components, and making recycling easier by requiring less deconstruction of the shoe to prepare it for recycling.

In some case, the continuous textile includes one or more layers. In some cases, an outer layer of the continuous textile defines at least a portion of the exterior surface of the upper portion, and an inner layer of the continuous textile defines at least a portion of the interior surface of the upper portion. In some cases, the textile properties of the interior surface are different than the textile properties of the exterior surface. For example, the interior surface may be brushed, flocked, or otherwise have different textile properties to soften a tactile feel of the interior surface. In some cases, the interior surface may include one or more different materials than the exterior surface. For example, the textile may include different fiber types or fiber ratios at the interior surface and the exterior surface. The above-mentioned features may provide particular advantages to wearers wearing the shoes without socks, because the wearer's foot may directly contact the upper portion while the shoes are worn.

In some cases, the shoe is designed to allow a wearer to wear the shoe without socks. In various embodiments, the shoe may include features to improve the performance of the shoe when worn without socks. The multi-region upper portion may improve the comfort of the shoe by reducing or eliminating seams that may irritate wearers, especially when lacking socks. In some cases, the multi-region upper portion defines an interior surface of a cavity adapted to receive a wearer's foot in addition to defining an exterior surface of the shoe.

In various embodiments, the upper portion is attached to a first side of a sole that defines, on a second opposite side, a tread surface that is adapted to contact the ground or other surfaces while the shoe is worn. The sole may be attached to the upper portion, for example using an adhesive. The shoe may define a cavity adapted to receive a wearer's foot. In some cases, an insole may be positioned in the cavity. In some cases, the insole cooperates with the upper portion to define the interior surface of the shoe. The insole may include a marking adhered to its top surface of the insole and designed to not interfere with the comfort or function of the insole.

As used herein, "textile" or "fabric" may refer to a flexible material consisting of a network of natural and/or artificial fibers (e.g., yarn or thread formed into a sheet) formed by any suitable process, including, but not limited to, weaving, knitting, spreading, crocheting, knotting, felting, bonding, braiding, and carpeting. A "knit textile" may refer to a textile formed by knitting, and consists of consecutive rows of intermeshing loops or stitches. A "continuous textile" may refer to a textile that is knit or otherwise formed as a single, unitary piece, in which an entire top surface is defined by a single piece and an entire bottom surface is defined by a single piece. The pieces that define the top surface and the bottom surface may be different layers of the textile, or one piece may define the entire top surface and the entire bottom surface. As a result, a continuous textile does not have multiple adjacent sections with seams therebetween. In various cases, a continuous textile may be attached to itself using a seam, for example to define a structure of the upper portion.

As used herein, "textile properties" may refer to properties that define the dimensions and characteristics of a textile, including, but not limited to, fiber properties (e.g., fiber type, size, and length), yarn properties (e.g., yarn diameter, twist, weight, size, count, fiber content or fiber ratio, ply, and strand count in plied yarn), weight, thickness, fabric structure, fabric density, weave properties (e.g., weave type, warp and filling yarn count), knit properties (e.g., knit type, wale and course count), finishes (e.g., chemicals, resins, starches, and waxes), and mechanical effects (e.g., calendaring, napping, flocking, and brushing).

As used herein, "textile characteristics" may refer to measures of the textile's performance, including, but not limited to, stiffness (e.g., resistance to stretching or bending), flexibility (e.g., reduced stiffness), breathability (e.g., air permeability), water resistance, moisture wicking, odor resistance, durability characteristics, visual characteristics (e.g., textile appearance), and tactile characteristics (e.g., textile feel). As used herein, the term "durability" may refer to the ability of materials (e.g., a textile) or objects (e.g., a shoe) to resist wear, deformation, and/or damage and/or to maintain its textile properties, structure, visual characteristics, and/or tactile characteristics. As used herein, "durability characteristics" may refer to measures of a textile's durability, including, but not limited to, abrasive strength (e.g., resistance to abrasion), bursting strength (e.g., ability to withstand forces applied at right angles to the plane of the fabric), and tensile strength (e.g., ability to withstand forces applied along the plane of the fabric).

FIG. 1 illustrates an example shoe 100 having a knit textile upper portion 110. The upper portion 110 may define a shape or structure of the shoe 100, and may be adapted to contain, comfort, and/or protect a foot of a wearer wearing the shoe 100. As described above, the shoe 100 may include an upper portion 110 constructed from a continuous textile (e.g., a knit textile) that defines multiple regions with different textile properties that may improve performance of the shoe, including durability and comfort. One or more textile properties may be varied across different regions of the upper portion 110 to achieve desired textile characteristics for each region to achieve desired shoe performance.

As noted above, the multi-region upper portion 110 may improve the durability of the shoe 100, for example by having thicker or stiffer regions that are less susceptible to damage or deformation at locations prone to higher applied forces. Similarly, the multi-region upper portion 110 may improve the comfort of the shoe 100, for example by varying thickness and flexibility across different regions to better support or comfort the wearer's foot. The regions of the upper portion 110 are discussed in more detail below with respect to FIGS. 3A-3C.

The upper portion 110 may define a first part of an exterior surface of the shoe, and a sole 120 may define a second part of the exterior surface of the shoe. The upper portion 110 may cooperate with one or more additional shoe components to define a cavity 160 for receiving a wearer's foot (not shown in FIG. 1). Additionally, the upper portion 110 may define a first part of an interior surface of the shoe 100. As noted above, the upper portion 110 may include one or more layers. In some cases, an outer layer of the upper portion 110 defines at least a portion of the exterior surface of the upper portion, and an inner layer of the upper portion defines at least a portion of the interior surface of the upper portion. In some cases, as discussed in more detail below with respect to FIG. 5, textile characteristics may vary between the interior surface and the exterior surface to achieve desired shoe performance. Additionally, textile characteristics and materials may vary at different locations on the interior surface, as discussed in more detail below with respect to FIG. 5.

As noted above, whereas many traditional shoes include upper portions formed from multiple different parts or components, in some cases, the upper portion 110 is formed from a continuous textile. The formation of the upper portion 110 using a continuous textile provides numerous advantages, including improving the comfort of the shoe 100 by removing seams that may irritate a wearer, and improving manufacturing efficiency by reducing the overall number of components in the shoe.

In various embodiments, the continuous textile that is used to form the upper portion 110 may be constructed by any suitable process, including, but not limited to, weaving, knitting, spreading, crocheting, knotting, felting, bonding, braiding, and carpeting. In some cases, the continuous textile is a knit textile. The knit textile may be knit or otherwise formed into a particular shape (e.g., the shape of the upper portion 110 shown in FIG. 3C). In some cases, the continuous textile is knit into a three-dimensional shape (e.g., a non-planar shape). In some cases, the continuous textile is cut or otherwise formed into the proper shape after it is constructed. In various embodiments, different regions, such as the reinforcement regions and flex regions described with respect to FIGS. 3A-3C below, have different textile properties to achieve different textile characteristics.

As noted above, the knit textile may include one or more layers that are attached together. In some cases, a first layer may have a first knit structure having first textile properties and a second layer may have a second knit structure having second textile properties. In some cases, multiple layers are formed together as part of a knitting process. The first and second layers may be interlaced with one another. For example, the knit structure of the first layer may be interlaced with the knit structure of the second layer, for example using the loop transfer technique.

The continuous textile may be formed of any suitable material or combination of materials. For example, a woven or knit textile may be formed using one or more types of yarn. The yarn may be formed using one or more natural or synthetic fibers twisted or otherwise bound together. Example fibers include cellulose fibers (e.g., *eucalyptus* fiber, bamboo fiber, rayon, and modal), wool, cotton, silk, polyester, nylon, and the like. In some cases, the yarn is formed using a blend of two or more fibers. For example, the yarn may be a blend of *eucalyptus* fiber and polyester. In some cases, the yarn is a plied yarn that includes multiple strands of yarn twisted or braided together.

The shoe 100 may include a tongue 130 that covers or conforms to the top of the wearer's foot. The tongue 130 and the upper portion 110 may cooperate to retain a wearer's foot in the cavity 160. In some cases, the tongue 130 is adapted to be positioned between a shoelace 150 and the wearer's foot. In some cases, the tongue 130 and the upper portion 110 cooperate to define an opening 170 into the cavity 160.

In various embodiments, the tongue 130 may be connected to (e.g., integrally formed with or attached to) the upper portion 110. In some cases, the tongue 130 is integrally formed with the upper portion 110 (e.g., formed from the same continuous textile as the upper portion). In other cases, the tongue is a separate component that is attached to the upper portion, for example by stitching, adhesives, or the like. The tongue 130 may be formed using the same or similar materials and processes as discussed above with respect to the upper portion 110.

In some cases, the shoe 100 includes eyelets 140 and shoelaces 150 passing through they eyelets. Together they may retain the shoe 100 to the wearer's foot, for example by tightening the shoe 100 around the wearer's foot. The eyelets 140 and the shoelaces 150 are discussed below in more detail with respect to FIG. 2.

The shoe 100 may also include a sole 120 that defines a tread surface that is adapted to contact the ground or other surfaces while the shoe is worn. The sole 120 may be attached to the upper portion 110, for example using an adhesive. The sole 120 is discussed in more detail below with respect to FIGS. 3B and 6.

In various embodiments, the shoe 100 may be assembled by attaching the eyelets 140 and (optionally) the tongue 130 to the upper portion 110 and attaching the upper portion 110 to the sole 120 using an adhesive or other fastening method. An insole may be inserted into the cavity 160, and the laces 150 may be threaded through the eyelets 140.

Figure 2:
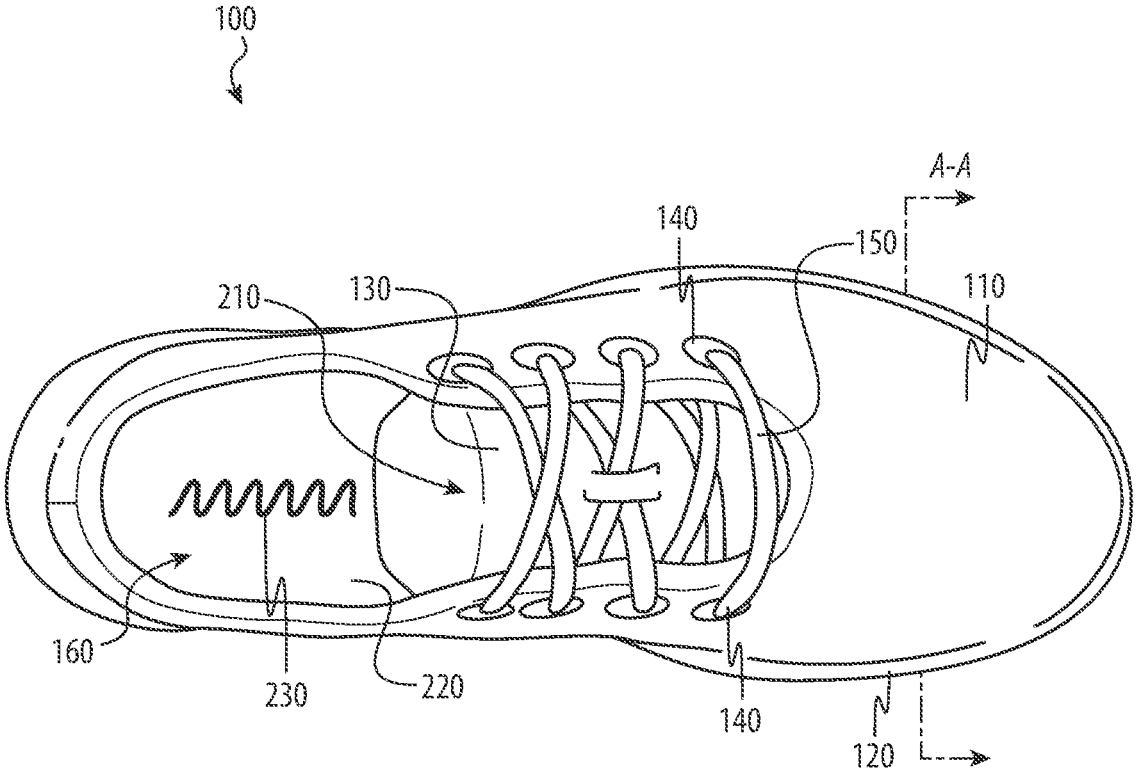
FIG. 2 illustrates a top view of the example shoe of FIG. 1.

FIG. 2 illustrates a top view of the example shoe 100. As noted above, the shoe 100 may define a cavity 160 adapted to receive a wearer's foot. In some cases, an insole 220 may be positioned in the cavity, and may define at least a portion of the interior surface of the shoe 100 that surrounds the cavity 160. For example, the insole 220 may define a foot bed configured to receive and contact a bottom surface of a foot of the wearer. The insole 220 may be adapted to be positioned between the wearer's foot and the sole 120 to cushion the wearer's foot during wear. The insole 220 may cooperate with the upper portion 110 and one or more additional components of the shoe 100 to define the interior surface of the shoe 100, as discussed in more detail below with respect to FIG. 5.

In various embodiments, the insole 220 may include a top surface defining a portion of the interior surface of the shoe 100 and a bottom portion that provides cushioning to the wearer's foot. The top surface may be formed of any suitable material or combination of materials, including wool, cotton, polyester, nylon, and the like. The bottom portion may be formed of any suitable material or combination of materials, including polyamides, polyethylene, polypropylene, polyurethane (e.g., thermoplastic polyurethane), ethyl vinyl acetate, and polyols. In some cases, the bottom portion is formed at least partially from a bio-based material, such as castor bean oil. As noted above, using bio-based materials may provide environmental benefits, including reduced emissions and ecological sustainability.

In some cases, the insole 220 includes a marking 230 that is attached to a top surface of the insole. The marking 230 may be designed to not interfere with the comfort or function of the insole 220. For example, the marking 230 may be designed to avoid adhering to a foot or sock contacting the insole 220.

In various embodiments, the marking 230 may be formed of any suitable material or combination of materials, including polyamides, polyethylene, polypropylene, polyurethane, and polyols. In some cases, the marking includes a thermoplastic material (e.g., thermoplastic polyurethane). The marking 230 may be bonded or otherwise attached to the top surface of the insole 220, for example using adhesives, heat treatment, high frequency welding and the like.

In some cases, the marking 230 includes a first layer formed of a thermoplastic material and one or more additional layers of ink. In some cases, the marking 230 may be formed using a sheet of thermoplastic material having a thickness between 25 micrometers and 75 micrometers. One or more layers of ink may be applied to the sheet of thermoplastic material, for example using a screen-printing process, to form a logo or other design on the marking 230. In some cases, five or more layers of ink are applied to the sheet of thermoplastic material, with each layer being allowed to dry between applications. The ink may be applied to multiple sections along the sheet of thermoplastic material, and the multiple sections may be separated (e.g., die cut) to form multiple markings 230 for use in multiple shoes 100.

In some cases, the marking 230 is attached to the top surface of the insole 220 using high frequency welding. In some cases, a high frequency welding mold may be heated to between 100 and 150 degrees Celsius and the marking 230 may be pressed against the top surface of the insole 220 using the mold to attach the marking to the insole. In some cases, the marking 230 may be pressed against the top surface of the insole 220 for a duration between 1 and 10 seconds. In some cases, the duration of the pressing may be varied based on environmental factors at the location of manufacturing, such as air temperature, humidity, and the like. For example, the duration of the pressing may be 2 seconds if the air temperature is above a threshold (e.g., 20 degrees Celsius) or 3 seconds if the air temperature is below the threshold. Similarly, the duration of the pressing may be 2 seconds if the humidity is above a threshold (e.g., 50% relative humidity) or 3 seconds if the humidity is below the threshold. Following the pressing, the insole 220 and marking 230 may be cooled at room temperature. In some cases, the cooling time is between 1 and 10 seconds.

As discussed above, the shoe 100 may include eyelets 140 and shoelaces 150 passing through the eyelets to retain the shoe 100 to the wearer's foot. Each eyelet 140 may define an opening through which a shoelace 150 may extend. In some cases, the upper portion 110 includes a gap 210 over the tongue 130. The tongue 130 may be configured to be positioned at least partially in the gap 210. As shown in FIG. 2, a first set of eyelets 140 may be positioned on a first side of the gap 210 and a second set of eyelets 140 may be positioned on a second side of the gap 210. The gap 210 may allow the upper portion 110 to contract or expand to achieve a better fit around a wearer's foot. The shoelace 150 may extend across the gap 210 and may be coupled to the upper portion 110 by passing through one or more eyelets 140 on either side of the gap. As a result, tightening the shoelace 150 may draw the opposing eyelets 140 toward each other, thereby reducing a width of the gap 210 and tightening the upper portion 110. Similarly, loosening the shoelace 150 may draw the opposing eyelets 140 away from each other, thereby increasing a width of the gap 210 and tightening the upper portion 110.

In various embodiments, each of the eyelets 140 may be positioned in an opening extending through the upper portion 110. The eyelets 140 may be formed using any suitable material or combination of materials, including, but not limited, to, polyamides, polyethylene, polypropylene, polyurethane (e.g., thermoplastic polyurethane), and polyols. In some cases, the eyelets 140 may be formed at least partially from bio-based materials, including plant-based polymers, natural oil polyols, and the like. In some cases, the eyelets 140 may include a bio-based plastic made using corn sugar. As noted above, using bio-based materials may provide environmental benefits, including reduced emissions and ecological sustainability.

In some cases, the eyelets 140 are formed from a thermoplastic material (e.g., thermoplastic polyurethane). The thermoplastic material may include a bio-based material, such as a polyol derived from corn sugar. In some cases, bio-based materials may make up 20% or more of the thermoplastic material. The thermoplastic material may be formulated into one or more sheets of stiff and elastomeric compound. Dye may be added to the thermoplastic material to color the eyelets 140. The sheets may be cut (e.g., punched, die-cut, or the like) into an annular ring shape having an opening through a central portion.

The eyelets 140 may be bonded or otherwise attached to the upper portion 110, for example using adhesives, heat treatment, high frequency welding and the like. In some cases, the eyelets 140 are attached to the upper portion 110 using high frequency welding. In some cases, a high frequency welding mold may be heated to between 100 and 150 degrees Celsius and each eyelet 140 may be pressed against the upper portion 110 using the mold to attach the eyelet to the upper portion. In some cases, the upper portion 110 may be pressed against the upper portion 110 for a duration between 1 and 10 seconds. A hole may be cut through the upper portion 110 that aligns with the opening in the eyelet 140 so that the shoelace 150 may extend through the eyelet 140 and the upper portion 110.

As noted above, the shoelace 150 may extend through the eyelets 140 to secure the shoe 100 to a wearer's foot. In some cases, the shoelace 150 includes a tubular outer portion and an inner fill. The shoelace 150 may be formed using any suitable material or combination of materials, including polyester, nylon, cotton, and the like. In some cases, the outer portion and/or the inner fill are formed from recycled materials, such as recycled polyester from plastic bottles. As noted above, using recycled materials instead of new materials reduces waste sent to landfills and incinerators and conserves natural resources, prevents pollution, and saves energy related to the collection and processing of new raw materials.

Figure 3A:
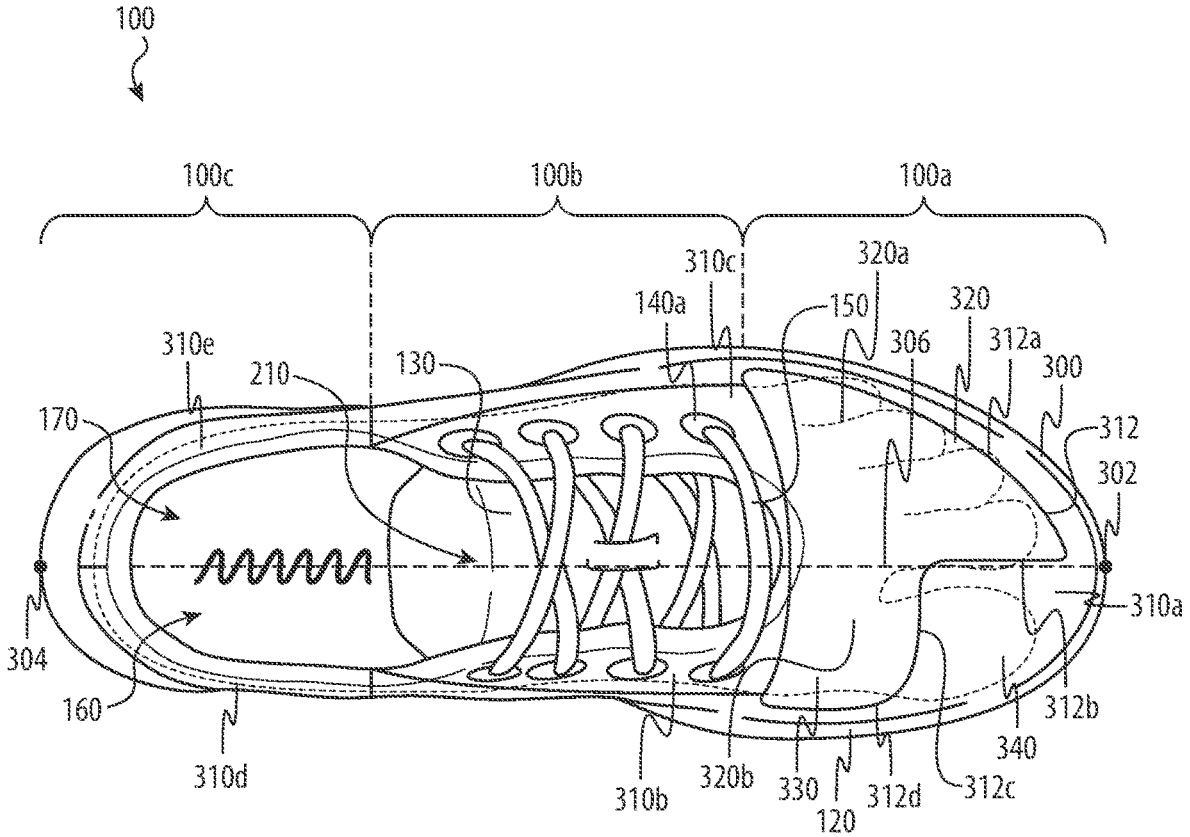
FIG. 3A illustrates a top view of the example shoe of FIG. 1.

As discussed above, the upper portion 110 may be constructed from a continuous textile (e.g., a knit textile) that includes multiple regions having different textile properties to improve the performance of the shoe, including durability and comfort, and providing environmental benefits. FIG. 3A illustrates a top view of the example shoe 100 showing different regions 310*a-e* and 320 of the upper portion 110 having different textile properties. FIG. 3A also shows an example position of a wearer's foot 330 while the shoe 100 is worn.

As noted above, the upper portion 110 may be formed at least partially using bio-based materials, such as *eucalyptus* fiber, which is a more sustainable and environmentally friendly material than materials used in many traditional shoes. In addition, the upper portion 110 being constructed from a continuous textile reduces the use of potentially harmful chemicals, such as adhesives, used in the shoe 100.

In various embodiments, the multi-region upper portion 110 may improve the durability of the shoe 100, the comfort of the shoe, and/or allow a wearer to comfortably wear the shoe with or without socks. In some cases textile properties and/or textile characteristics, including textile thickness or flexibility, may be varied across the different regions 310*a-e* and 320 to achieve desired shoe performance. The locations, sizes, and textile properties of the regions 310*a-e* and 320 may be determined based on their positions with respect to the wearer's foot 330 and/or their positions with respect to other components of the shoe 100.

In some cases, the upper portion 110 may define one or more reinforcement regions 310 (e.g., reinforcement regions 310*a*, 310*b*, 310*c*, 310*d*, and 310*e*) at locations that are more prone to damage or deformation, for example because they are subject to greater forces than other regions. For example, it may be desirable for a reinforcement region 310 of the upper portion to have a higher stiffness, bursting strength, tensile strength, or abrasive strength compared to other regions, including flex region 320.

In some cases, the upper portion 110 may define one or more flex regions (e.g., flex region 320) at locations that are less prone to damage or deformation, for example because they are subject to lesser forces than other regions. Accordingly, the textile properties for the flex region 320 may be selected to optimize or otherwise enhance comfort and other textile characteristics. For example, it may be desirable for the flex region 320 to have increased breathability and flexibility compared to other regions. The location of the flex region 320 on top of the wearer's foot 330, combined with the fact that the location is less prone to damage or deformation than other locations, may make the flex region well-suited to be more breathable to vent heat from the wearer's foot to make the wearer more comfortable. The different regions of the upper portion 110 cooperate to provide enhanced performance of the shoe 100 as a whole, including improved durability and comfort.

In some cases, a part of the reinforcement region 310*a* may be configured to be positioned at least partially over a toe of the wearer's foot 330, such as the wearer's big toe 340. The wearer's big toe 340 may exert forces on the upper portion 110 in the area near the toe, making this area more prone to damage or deformation than other areas of the upper portion. As a result, this area requires a higher stiffness, abrasive strength, burst strength, and/or tensile strength than other areas of the upper portion 110. In some cases, at least a part of the reinforcement region 310*a* and/or the flex region 320 may be positioned in a toe section 100*a* of the shoe 100. In some cases, the reinforcement region 310*a* may extend beyond the toe section 100*a*, for example into a middle section 100*b* of the shoe 100. In some cases, the reinforcement region 310*a* may have a part that extends farther from a perimeter 300 of the shoe 100 than other parts of the reinforcement region 310*a*, for example to be positioned over a toe 340 of a wearer.

In some embodiments, as shown in FIG. 3A, the reinforcement region 310*a* and the flex region 320 may cooperate to occupy all or most of the area of the upper portion 110 in the toe section 100*a* of the shoe 100. In some cases, the reinforcement region 310*a* may at least partially surround the flex region 320. In some cases, the flex region 320 is shaped based on a shape of the reinforcement region 310*a*. For example, the part of the reinforcement region 310*a* that is configured to be positioned over the toe 340 of the wearer may define a portion of the shape of the flex region 320. In some cases, the flex region 320 may have a stepped shape when viewed from above, for example as shown in FIG. 3A.

In some cases, the flex region 320 may be intersected by a longitudinal axis 306 that extends from a front tip 302 to a rear tip 304 of the shoe. The flex region 320 may define a first part 320*a* positioned on a first side of the longitudinal axis 306 and a second part 320*b* positioned on a second side of the longitudinal axis 306. In some cases, a first area of the first part 320*a* is larger than a second area of the second part 320*b*. For example the first area may be 50% larger than the second area. In some cases, the first area is between 110% and 200% of the second area.

In some cases, the first part 320*a* occupies more than one third of the total area of the upper portion 110 in the toe section 100*a* and on the first side of the longitudinal axis 306. In some cases, the first part 320*a* occupies between one third and two thirds of the total area of the upper portion 110 in the toe section 100*a* and on the first side of the longitudinal axis 306. In some cases, the second part 320*b* occupies less than one third of the total area of the upper portion 110 in the toe section 100*a* and on the second side of the longitudinal axis 306. In some cases, the second part 320*b* occupies between one sixth and one third of the total area of the upper portion 110 in the toe section 100*a* and on the second side of the longitudinal axis 306. In some cases, as shown in FIG. 3A, an indent of the reinforcement region extends halfway, or between 40% and 60% of the way, from a point of the flex region 320 farther away from the tongue 130 (along the longitudinal axis 306) to an edge of the tongue adjacent the flex region.

In some embodiments, the upper portion 110 may define a boundary 312 between the flex region 320 and the reinforcement region 310*a*. The boundary 312 may include a first segment 312*a* that extends from a first location near an eyelet 140*a* of the shoe 100 to a second location near the front tip 302 of the shoe. The first segment 312*a* of the boundary 312 may have a contour that approximately follows a contour of the perimeter 300 of the shoe 100. The boundary 312 may include a second segment 312*b* that extends from the second location and away from the front tip 302 to a third location near a center of the toe section 100*a* of the shoe 100. The boundary 312 may include a third segment 312*c* that extends from the third location toward the perimeter 300 of the upper portion 110 to a fourth location. The boundary 312 may include a fourth segment 312*d* that extends from the fourth location to a fifth location near a second eyelet 140*b* of the shoe 100. In some cases, the second eyelet 140*b* is on an opposite side of the gap 210 from the first eyelet 140*a*.

In some cases, reinforcement regions 310*b* and 310*c* are positioned in a middle section 100*b* of the shoe 100 and may be positioned adjacent to the gap 210 and/or around one or more eyelets 140. The reinforcement region 310*b* may be positioned on a first side of the gap 210 and the reinforcement region 310*c* may be positioned on a second side of the gap 210 opposite the first side. The areas of the upper portion 110 adjacent to the gap 210 and around the eyelets 140 may be more prone to damage or deformation than other areas of the upper portion 110, for example because of forces applied to the upper portion by the shoelace 150 and eyelets 140. In some cases, the reinforcement region 310*a* may extend between each of the reinforcement regions 310*b* and 310*c* and the perimeter 300 of the upper portion. In some cases, the shoelace 150 and/or eyelets 140 may exert a pulling or stretching force on the upper portion 110 in the reinforcement regions 310*a*, 310*b*, and 310*c* as the shoelace 150 is manipulated (e.g., tightened, loosened) and as the shoes are worn.

To avoid excessive stretching, deformation, and/or damage of the reinforcement regions 310*b*, and 310*c*, the reinforcement regions 310*b*, and 310*c* may have different textile properties than other regions of the upper portion 110 (e.g., the flex region 320 and other reinforcement regions 310). In some cases, the reinforcement regions 310*b*, and 310*c* may be thicker than one or more other regions of the upper portion 110 and may resist the force applied by the shoelace 150 to reduce stretching of the reinforcement regions. As a result, these areas may have a higher stiffness, abrasive strength, burst strength, and/or tensile strength than other areas of the upper portion 110.

In some cases, reinforcement regions 310*d* and 310*e* are positioned in a heel section 100*c* of the shoe 100, and may extend between the opening 170 and the sole 120. The areas of the upper portion 110 between the opening 170 into the cavity and the sole 120 may be more prone to damage or deformation than other areas of the upper portion 110, for example due to forces applied to these areas by the wearer's foot 330. As a result, these areas require a higher stiffness, abrasive strength, burst strength, and/or tensile strength than other areas of the upper portion 110. Additionally, the areas of the upper portion 110 between the opening 170 into the cavity and the sole 120 are positioned around the opening 170, and accordingly may require a higher stiffness than other areas of the upper portion 110 to maintain the shape and structure of the shoe.

As shown in FIG. 3A, in some cases, one or more reinforcement regions 310 (e.g., reinforcement regions 310*a*, 310*d*, and 310*e*) may extend along a perimeter 300 of the upper portion 110 where the upper portion meets the sole 120. The areas near the perimeter 300 may be more prone to damage or deformation than other areas of the upper portion 110. For example, the areas near the perimeter 300 are closer to the ground than other areas of the upper portion 110. Similarly, the areas near the perimeter 300 are closer to the outer edge of the shoe 100 than other areas of the upper portion 110, and so objects may be more likely to contact these areas during wear. Additionally, the wearer's foot may cause the upper portion 110 to pull or twist against the sole 120 at the areas near the perimeter 300. In some cases, one or more reinforcement regions 310 cooperate to extend entirely around the shoe 100 along the perimeter 300. As a result, these areas require a higher stiffness, abrasive strength, burst strength, and/or tensile strength than other areas of the upper portion 110. In some cases, one or more reinforcement regions 310 is positioned between a flex region (e.g., flex region 320) and the perimeter 300.

In various embodiments, desired textile characteristics for a region, including stiffness, breathability, bursting strength, tensile strength, and abrasive strength may be achieved by selecting textile properties that yield the desired textile characteristics.

In some cases, varying a thickness (e.g., distance from an interior surface to an exterior surface) and/or density (e.g., amount of yarn per area) of the upper portion 110 across different regions can be used to achieve desired textile characteristics. For example, in some cases, a first region (e.g., a reinforcement region 310) of the upper portion 110 having a first thickness may have an increased stiffness, a higher bursting strength, a higher tensile strength, and/or a higher abrasive strength compared to a second region (e.g., a flex region 320) having a second thickness less than the first thickness. Similarly, in some cases, a first region (e.g., a reinforcement region 310) of the upper portion 110 having a first density may have an increased stiffness, a higher bursting strength, a higher tensile strength, and/or a higher abrasive strength compared to a second region (e.g., a flex region 320) having a second density less than the first density.

The thickness and/or density of a region of the upper portion 110 may be determined by a thickness of fibers in the yarn used in the region, a thickness of strands of yarn used in the region, a number of plied or braided yarn strands in a plied yarn, a density of the knit pattern in the region, and the like. Accordingly, a first region (e.g., a reinforcement region 310) of the upper portion 110 having a first thickness may have thicker fibers, thicker yarn, and/or a denser knit pattern compared to a second, less thick region (e.g., a flex region 320). Similarly, a first region (e.g., a reinforcement region 310) of the upper portion 110 having a first density may have thicker fibers, thicker yarn, and/or a denser knit pattern compared to a second, less dense region (e.g., a flex region 320).

Whereas a thicker and/or denser region of the upper portion 110 may be stiffer, have a higher bursting strength, a higher tensile strength, and/or a higher abrasive strength, a thinner and/or less dense region of the upper portion 110 may be more breathable (e.g., have a higher air permeability) and/or more flexible. As such, some regions of the upper portion 110 may be thinner and/or less dense to achieve flexibility and breathability, which may improve the comfort of the shoe 100 by allowing moisture evaporation from the wearer's foot.

In some cases, the types of fibers and fiber ratio (e.g., the ratio of different fibers) in a yarn and/or a yarn type may vary across different regions of the upper portion 110 to change a thickness and/or achieve desired textile characteristics, including tactile characteristics and durability characteristics. For example, a first region (e.g., a reinforcement region 310) may include a first yarn having a first blend of fibers at a first ratio and a second region (e.g., a flex region 320) may include a second yarn having a second blend of fibers at a second ratio. In some cases, plied yarns and/or multiple yarns are used in the same region. Plied yarns include multiple strands of yarn that are twisted or braided together to create a thicker yarn.

In some cases, one or more reinforcement regions 310 include a thermoplastic material that is heated during the manufacturing process to change the textile characteristics within the regions. In some cases, the yarn used in one or more regions of the upper portion include a coating (e.g., resin) or one or more fibers formed of a thermoplastic material. In some cases a film that includes a thermoplastic material is applied to one or more regions as part of the manufacturing process. The region may be heated as part of the manufacturing process, for example after the upper portion is constructed, to change textile characteristics of the region. The reinforcement regions 310*d* and 310*e* may be heated during the manufacturing process to activate (e.g., melt) the thermoplastic material to change the textile characteristics of the regions. In some cases, the thermoplastic material increases a stiffness, abrasive strength, burst strength, and/or tensile strength of the region(s) (e.g., reinforcement regions 310) to which it is applied. For example, in some cases, the thermoplastic materials may help to resist the force applied by the shoelace 150 to reduce stretching of the reinforcement regions 310*b* and 310*c*. Example thermoplastic materials include ethylene vinyl acetates (EVAs), polyamides, polyesters, and polyurethanes.

In some embodiments, the thermoplastic material, when melted, may fill spaces between loops within the knit pattern of the upper portion 110. In some cases, the thermoplastic material, when melted, may coat and/or be absorbed into the yarn and/or fibers forming the knit textile. Once the knit textile is cooled, the textile properties of the region(s) containing the thermoplastic material may differ from those other regions of the shoe 100. For example, the thermoplastic material may reduce bending or stretching of the knit textile to increase a stiffness, tensile strength, and or burst strength of the material. Similarly, the thermoplastic material may bond to, coat, or otherwise form a barrier around the textile and/or the yarn or fibers within the textile to prevent abrasion or other damage. In various embodiments, the thermoplastic material may not substantially change an appearance of the knit textile. For example, the thermoplastic material may not be visible once it has been melted into the knit textile. The thermoplastic material may be designed to melt or flow at temperatures above normal environmental temperatures, but below where the other materials in the upper portion 110 would scorch or burn.

In some cases, the upper portion 110 is heated to a temperature between 220 degrees Celsius and 300 degrees Celsius to activate (e.g., melt) the thermoplastic material, for example using a steam iron. Once the upper portion 110 cools to a temperature between 150 degrees Celsius and 220 degrees Celsius, the thermoplastic material is integrated into the upper portion, and the upper portion may be heated to a temperature between 200 degrees Celsius and 220 degrees Celsius without re-melting the thermoplastic material or causing the textile properties of the upper portion to be further changed.

In some cases, two or more of the reinforcement regions 310, have the same textile properties as one another. As shown in FIG. 3A, a reinforcement region may be adjacent to and/or contiguous with one or more other reinforcement regions. In various embodiments, the border between regions (e.g., reinforcement regions and/or flex regions) having different textile properties may be a distinct border in which the textile properties transition across a relatively small distance (e.g., 0.5 mm-1 mm) or a gradual border in which the textile properties change across a relatively long distance (e.g., 1 mm-10 mm). In either case, the border may be visible or invisible. In some cases, different textile properties may change across different distances.

Traditional methods for achieving desired bursting strength or other characteristics may include adding a separate component to a surface or between layers of the upper portion 110. In contrast, varying the textile properties of a continuous textile that forms the upper portion 110 avoids having multiple seams which may cause discomfort to a wearer of the shoe 100, and especially a wearer wearing the shoe without socks. Additionally, avoiding having a separate component reduces possible failure points (e.g., seams) and improves the efficiency of manufacturing and ability to recycle the shoe 100 by reducing the overall number of components of the shoe.

Figure 3B:
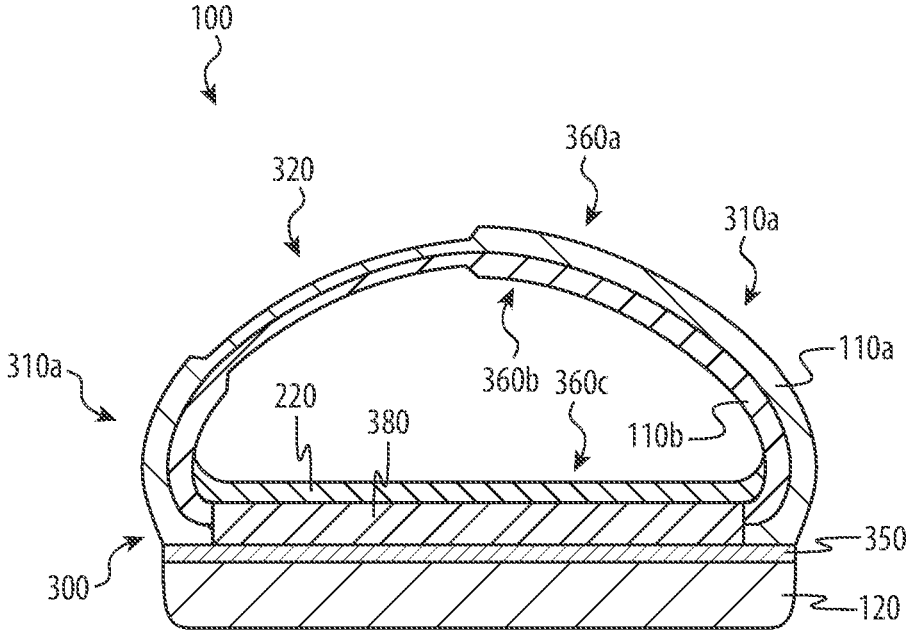
FIG. 3B illustrates a cross-section of the example shoe of FIG. 1 taken through section line A-A of FIG. 2.

As noted above, in some cases, the reinforcement regions may be thicker than one or more surrounding regions (e.g., a flex region). FIG. 3B illustrates a cross-section of the example shoe 100 showing a thicker reinforcement region 310*a*, taken through section line A-A of FIG. 2. As shown in FIG. 3B, the reinforcement region 310*a* may have a first thickness and the flex region 320 may have a second thickness less than the first thickness. As a result, the reinforcement region 310*a* may have different textile characteristics than the flex region 320, including higher stiffness, abrasive strength, burst strength, and/or tensile strength.

As noted above, in some cases, the continuous textile that forms the upper portion 110 includes multiple layers. In some cases, the upper portion 110 includes an outer layer 110*a* and an inner layer 110*b*. The outer layer 110*a* may form an exterior surface 360*a* of the upper portion 110, and the inner layer 110*b* may form an interior surface 360*b* of the upper portion 110. In some cases, both the outer layer 110*a* and the inner layer 110*b* may extend along the entire upper portion 110.

In some cases, the outer layer 110*a* and the inner layer 110*b* may have different textile characteristics at corresponding locations on the upper portion 110. For example, a textile feel or abrasive strength of the outer later 110*a* may differ from the inner layer 110*b*. The different textile characteristics of the different surfaces may be a result of different textile properties between the outer layer 110*a* and the inner layer 110*b*, including yarn properties, knit properties, thickness, mechanical effects (e.g., brushing) and the like.

In some cases, the layers of the upper portion 110 (e.g., outer layer 110*a* and inner layer 110*b*) are formed together as part of a knitting process. In some cases, the outer layer 110*a* and the inner layer 110*b* may be interlaced with one another to form a continuous textile. For example, the knit structure of the first layer may be interlaced with the knit structure of the second layer, for example using the loop transfer technique. In some cases, the outer layer 110*a* and the inner layer 110*b* may be otherwise attached or affixed to one another, for example using adhesives.

In addition to the textile properties differing among different layers, the textile properties of each layer 110*a*, 110*b* may differ at different locations of the upper portion 110. For example, as shown in FIG. 3B, the outer layer 110*a* may be thicker in the reinforcement region 310*a* than the outer layer in the flex region 320, and the inner layer 110*b* may be thicker in the reinforcement region 310*a* than the inner layer in the flex region 320. In some cases, textile properties may vary in less than all of the layers. For example, one layer may be thicker in a reinforcement region 310 than in the flex region 320, and another layer may be a same thickness in the reinforcement region 310 as in the flex region 320.

Figure 3C:
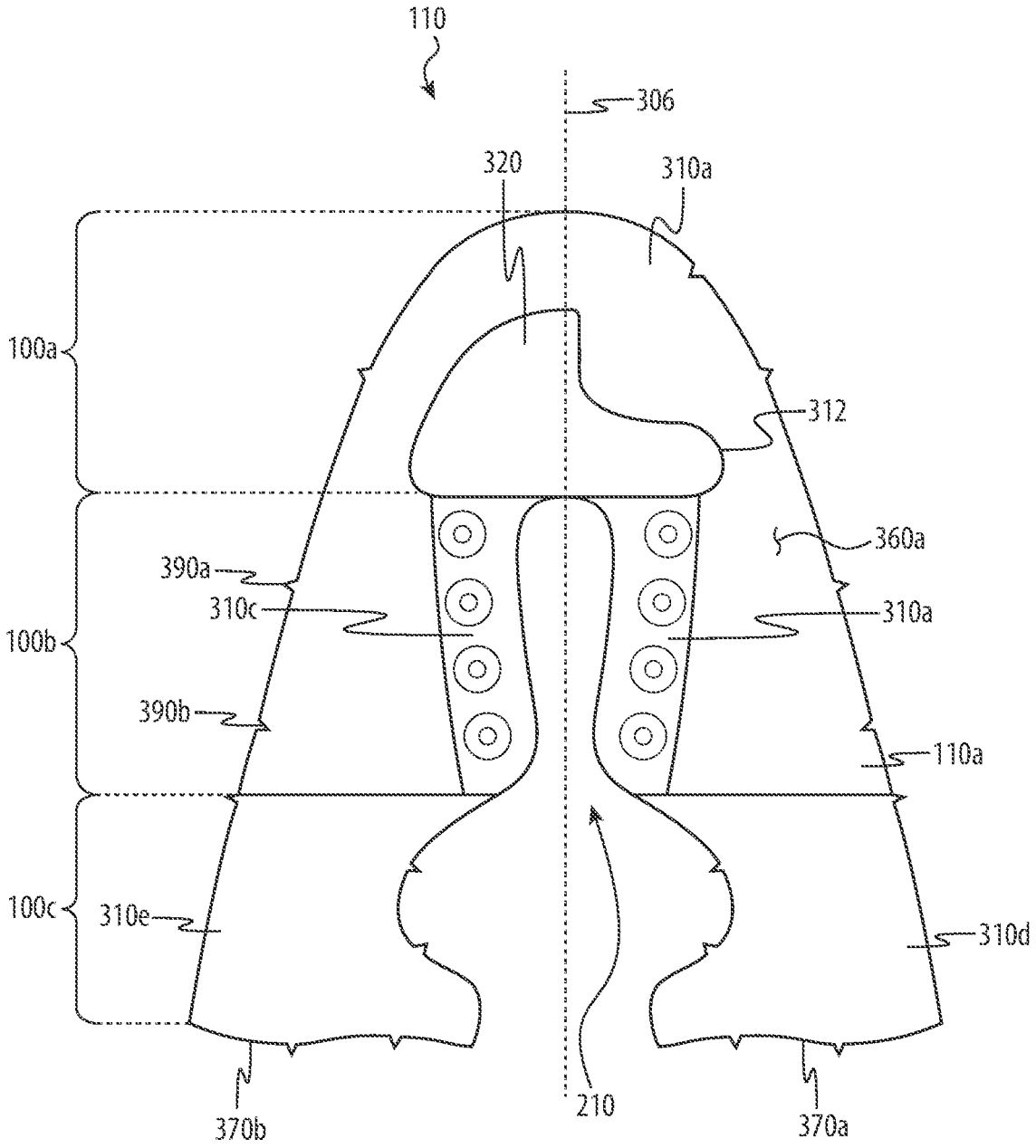
FIG. 3C illustrates an outer layer of the example knit textile upper portion of FIG. 1 as a continuous textile in a pre-assembly configuration.
Figure 3D:
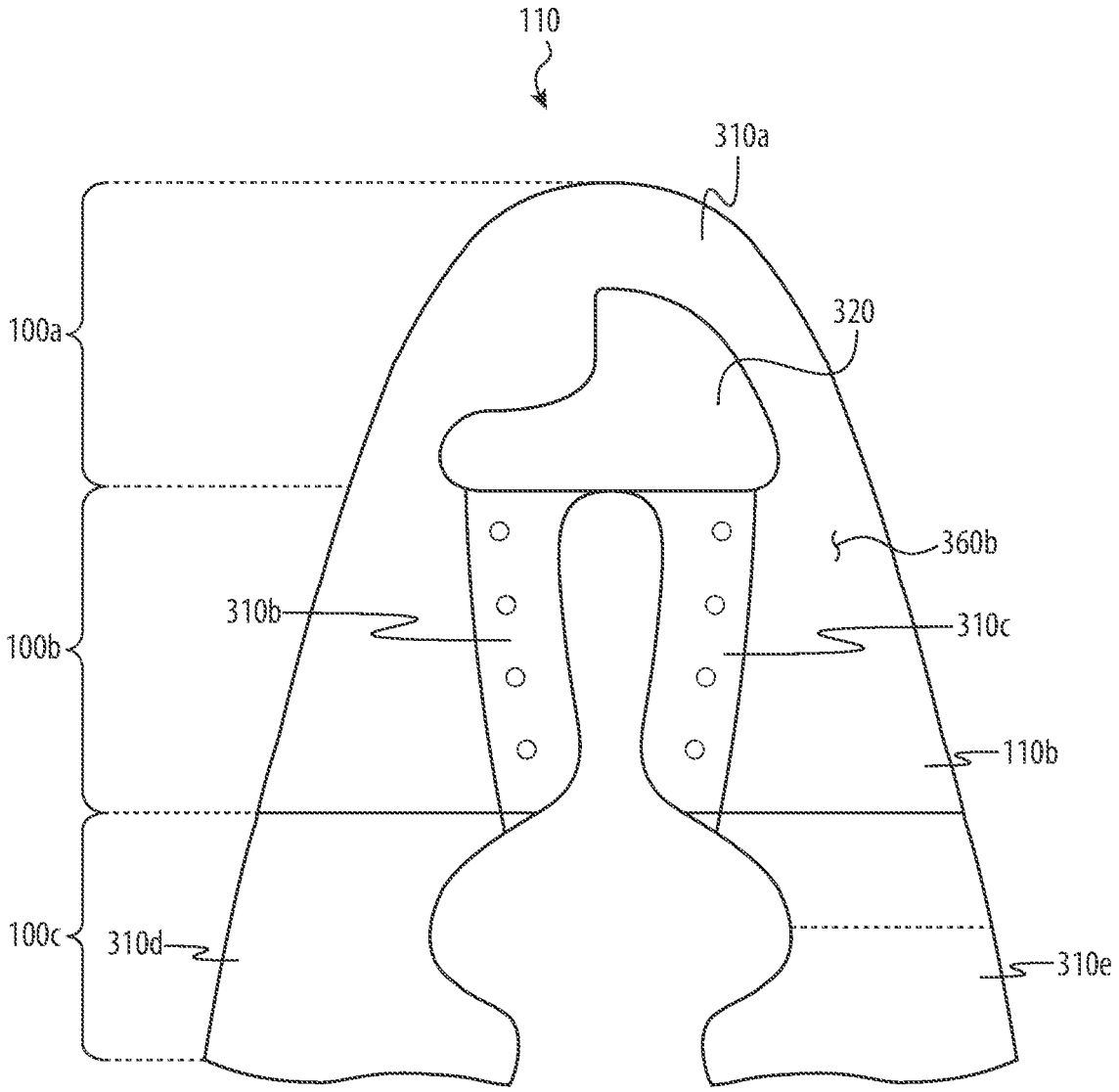
FIG. 3D illustrates an inner layer of the example knit textile upper portion of FIG. 1 as a continuous textile in a pre-assembly configuration.

As discussed above, the upper portion 110 may be formed from a continuous textile. As noted above, the upper portion 110 may include multiple layers (e.g., outer layer 110*a* and inner layer 110*b* discussed in FIG. 3B). FIGS. 3C and 3D illustrate the example knit textile upper portion 110 as a continuous textile in a pre-assembly configuration. FIGS. 3C and 3D illustrate the different regions 310*a-e* and 320 of the upper portion 110 shown in FIG. 3A. FIG. 3C illustrates the outer layer 110*a* of the upper portion 110 that defines the exterior surface 360*a* of the upper portion 110. FIG. 3D illustrates the inner layer 110*b* of the upper portion 110 that defines the interior surface 360*b* of the upper portion 110.

In some cases, as noted above, the textile properties may be different in different layers of the upper portion 110 and/or in different regions of the upper portion 110. For example, types and amounts of yarn used in each region and each layer may vary. With reference to FIG. 3C, the reinforcement region 310*a* in the outer layer 110*a* may include a yarn comprising a mixture of man-made fiber (e.g., polyester) and a bio-based fiber (e.g., *eucalyptus* fiber) and a yarn comprising a thermoplastic material. For example, in some cases, the reinforcement region 310*a* in the outer layer 110*a* includes a first yarn that is plied or pre-twisted yarn having three strands comprising polyester and *eucalyptus* fiber (e.g., TENCEL) and a second yarn formed of thermoplastic nylon.

In some cases, the content of the first yarn may be between 60% and 80% *eucalyptus* fiber (e.g., TENCEL) and between 20% and 40% polyester. For example, the content of the first yarn may be 70% *eucalyptus* fiber and 30% polyester. This blend of fibers in a yarn may provide advantages, including a desired textile feel, bursting strength, abrasive strength. In some cases, the blend of fibers may be optimized or otherwise enhanced to balance absorption and distribution of moisture. In some cases, the *eucalyptus* fiber may absorb or distribute moisture across an area of the textile, and the polyester may wick moisture to cause it to be evaporated. In some cases, the thermoplastic nylon may increase a stiffness and/or abrasive strength of the reinforcement region 310*a* in the outer layer 110*a*. The reinforcement regions 310*b*, 310*c*, 310*d*, and 310*e* in the outer layer 110*a* may include the same first and second yarn as the reinforcement region 310*a* in the outer layer 110*a*.

In some cases, the flex region 320 in the outer layer 110*a* includes the first yarn discussed above. In some cases, the flex region 320 does not include a thermoplastic material, which contributes to increased flexibility (reduced stiffness) and breathability.

With reference to FIG. 3D, the reinforcement region 310*a* in the inner layer 110*b* may include the first yarn discussed above, a third yarn having 2 strands of solid yarn comprising polyester and *eucalyptus* fiber, and a fourth yarn comprising nylon and spandex. In some cases, the third yarn comprises the same content of *eucalyptus* fiber and polyester as the first yarn discussed above. In some cases, the fourth yarn comprises between 85 and 95% nylon and between 5% and 15% spandex. For example, the fourth yarn may be H2070 nylon/spandex comprising 92% nylon and 8% spandex. In some cases, one strand of the fourth yarn may be pre-twisted with the three strands of the first yarn.

In some cases, the reinforcement regions 310*b* and 310*c* in the inner layer 110*b* include the first yarn, the second yarn, the third yarn, and the fourth yarn discussed above. Using all four yarns in the reinforcement regions 310*b* and 310*c* in the inner layer 110*b* may increase a stiffness, thickness, and/or other textile characteristics of the reinforcement regions 310*b*.

In some cases, the reinforcement regions 310*d* and 310*e* in the inner layer 110*b* include the first yarn and the fourth yarn discussed above. In some cases, one strand of the fourth yarn may be pre-twisted with the three strands of the first yarn. In some cases, the flex region 320 in the inner layer 110*b* includes the first yarn and the fourth yarn discussed above. In some cases, one strand of the fourth yarn may be pre-twisted with the three strands of the first yarn.

As noted above, in some cases, the fourth yarn is used in all regions in the inner layer 110*b* of the upper portion 110. In some cases, the fourth yarn may increase a softness of a tactile feel of the interior surface 360*b* defined by the inner layer 110*b*.

In some cases, the tongue 130 of the shoe 100 includes similar yarn compared to the upper portion 110. In some cases, the tongue includes an outer layer comprising the first yarn and an inner layer comprising the first yarn and the third yarn.

Figure 4:
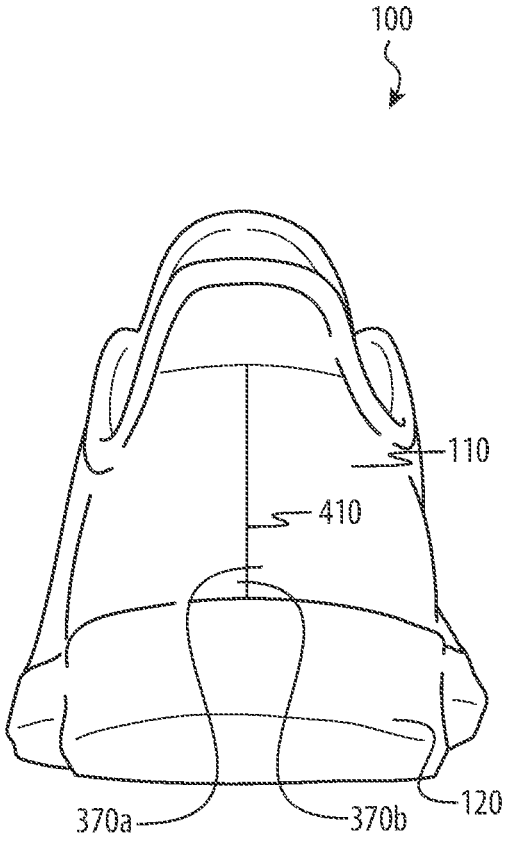
FIG. 4 illustrates a rear view of the example shoe of FIG. 1.

As noted above, in various embodiments, the shoe 100 may be assembled by attaching the eyelets 140 and (optionally) the tongue 130 to the upper portion 110 and forming the upper portion 110 into a desired three-dimensional shape, for example using a mold. An edge 370*a* of the upper portion 110 may be attached to an edge 370*b* of the upper portion to hold the shape of the upper portion 110 and construct the shoe 100. FIG. 4 illustrates a rear view of the example shoe 100 showing the edges 370*a* and 370*b* attached at a seam 410. The edges 370*a* and 370*b* may be attached using any suitable fastening technique, including adhesives, stitching, bonding, and the like.

The shaped upper portion 110 may be attached to the sole 120 using an adhesive or other fastening method. As shown in FIG. 3B, the shoe 100 may include a strobel 380 that encloses the bottom of the upper portion 110. In some cases, the strobel 380 may be attached to the upper portion 110 at or near a perimeter of the upper portion 110. For example, a perimeter of the strobel 380 may be attached to the perimeter of the upper portion 110. In some cases, as shown in FIG. 3C, the upper portion 110 may include attachment features 390*a* and 390*b* for attaching the upper portion 110 to the strobel 380. In some cases, the strobel 380 has attachment features that correspond to the attachment features 390 of the upper portion 110.

An adhesive 350 may be applied between a top surface of the sole 120 and a bottom surface of the strobel 380 and/or a surface of the upper portion 110 at or near a perimeter of the sole to attach the sole to the upper portion. In some cases the strobel 380 is omitted and the upper portion 110 is attached directly to the sole 120 using adhesive or another fastener. In some cases, the strobel 380 may be a part of the upper portion 110. Following attachment of the upper portion 110 to the sole, the insole 220 may be inserted into the cavity 160. As noted above, an upper surface 360*c* of the insole 220 may define a portion of the interior surface of the shoe 100. An interior surface 360*b* of the upper portion 110 may define an additional portion of the interior surface of the shoe 100.

The positions and textile properties of regions 310*a-e* and 320 shown in FIGS. 3A-3C are examples and are not meant to be limiting. The upper portion 110 may include more or fewer regions having different textile properties, and the regions may be located in different positions of the upper portion 110. Additionally, any combination of one or more of the textile properties discussed herein may be varied across different regions. The different textile properties of the different regions of the upper portion 110 may be achieved using a variety of techniques appropriate for the particular desired textile properties, including, but not limited to, material selection, manufacturing techniques, pre-processing techniques, post-processing techniques, and the like.

Figure 5A:
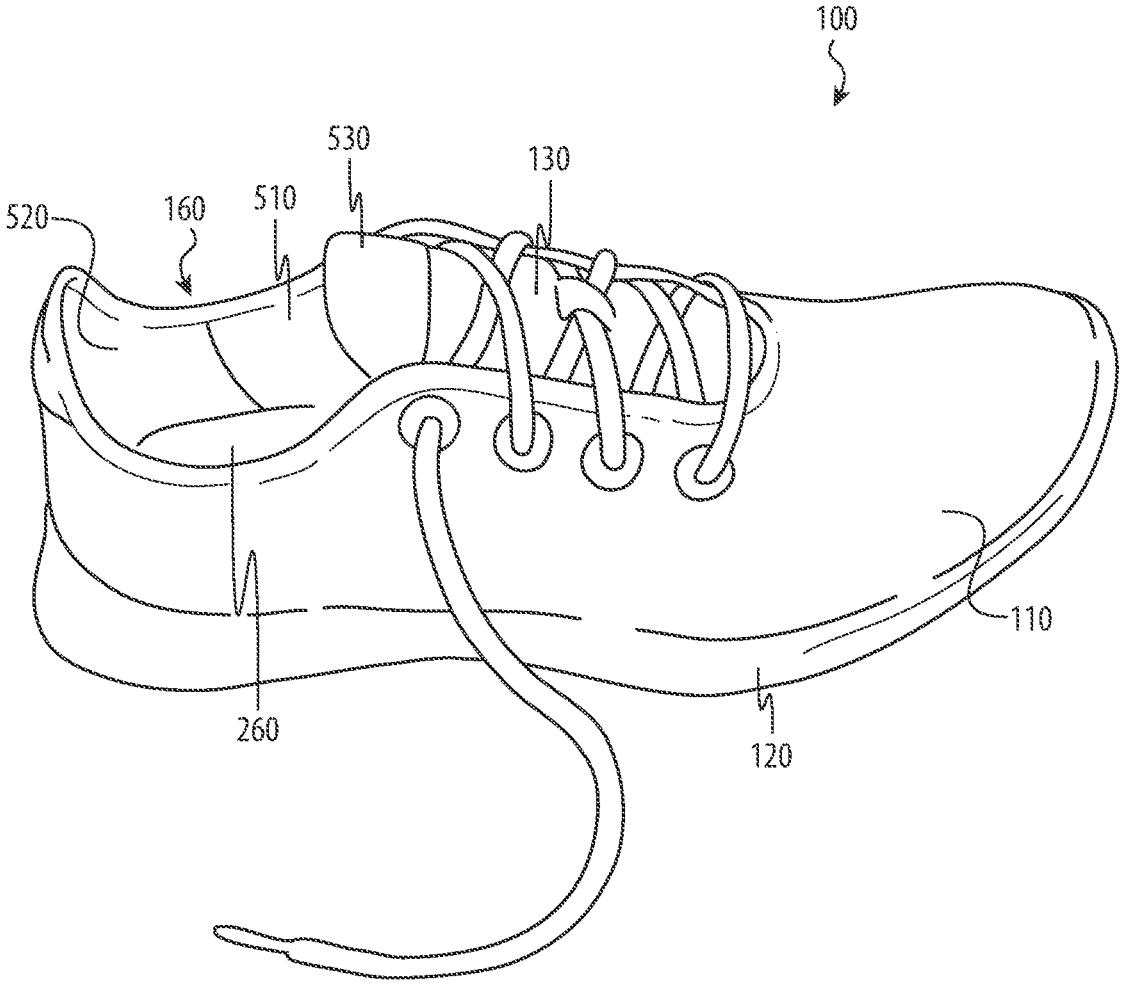
FIG. 5A illustrates the example shoe of FIG. 1.

As noted above, in some cases, one or more regions of an interior surface of the shoe 100 may have different textile properties than regions of the exterior surface and/or other regions of the interior surface. FIG. 5A illustrates the example shoe 100 and shows part of the interior surface 360*b* of the upper portion 110, which may be brushed or otherwise treated to soften the interior surface. In some cases, a region of the upper portion 110 may have different textile characteristics on an exterior surface than it has on an interior surface. For example, the tactile feel may be softer on the interior surface 360*b* than on an exterior surface at the same location of the upper portion 110. The interior surface 360*b* may provide advantages including improving the comfort of the shoe to a wearer, including a wearer wearing the shoe 100 without a sock. The different textile characteristics of the interior surface 360*b* may be achieved by processing the textile (e.g., brushing or flocking) differently on each surface and/or using different materials at the different surfaces.

Figure 5B:
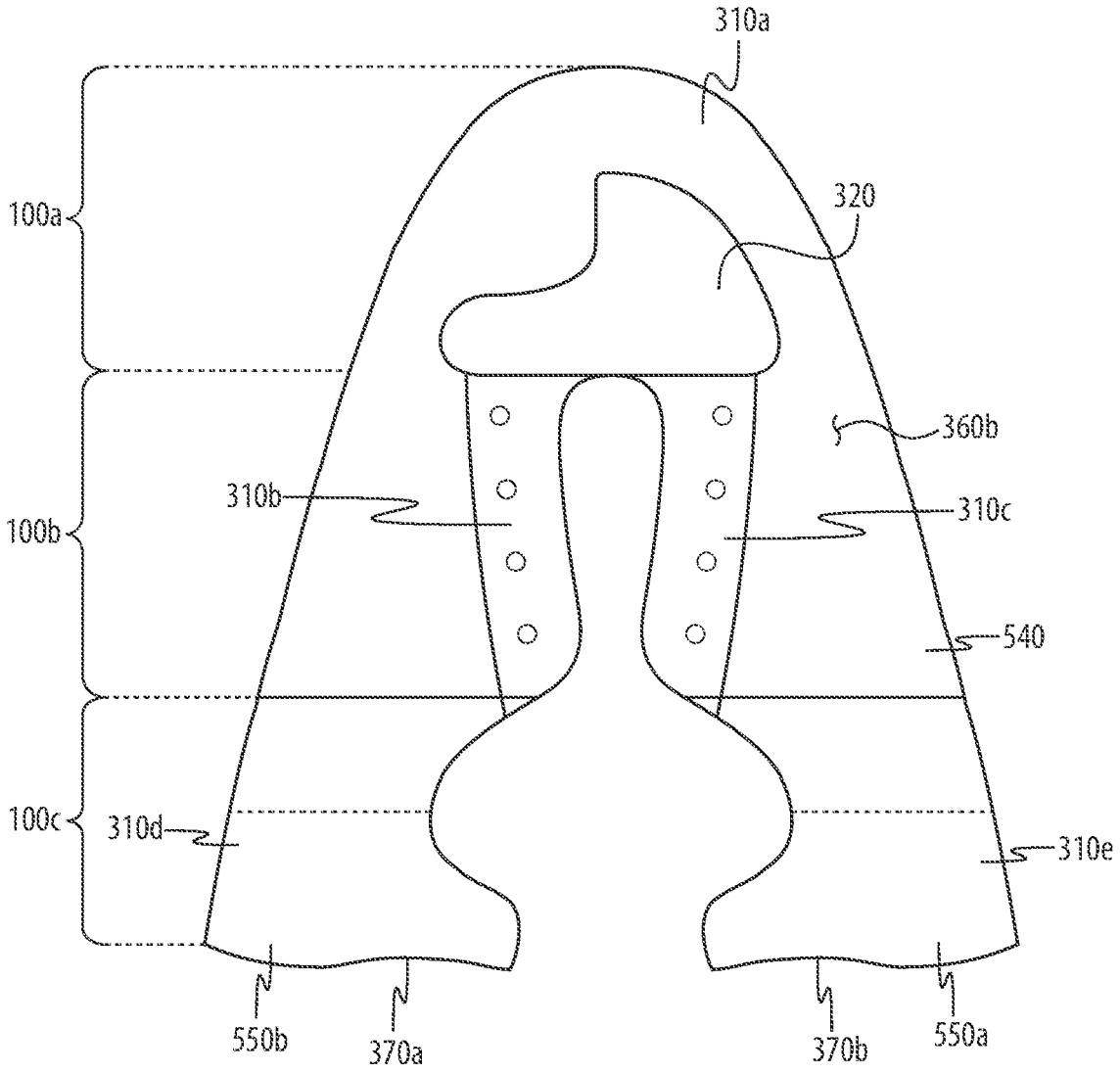
FIG. 5B illustrates an interior surface of the example knit textile upper portion of FIG. 1 in a pre-assembly configuration.

In some cases, different regions of the interior surface 360*b* may have different textile characteristics, including tactile feel, water resistance, moisture wicking, and odor resistance. FIG. 5B illustrates the inner layer 110*b* of the example knit textile upper portion 110 in a pre-assembly configuration similar to FIG. 3D. As shown in FIG. 5B, the interior surface 360*b* may include regions 540, 550*a*, and 550*b*. The regions 550*a* and 550*b* may be connected, for example at seam 410 (shown in FIG. 4), when the shoe 100 is assembled.

In various embodiments, regions 550*a* and 550*b* of the interior surface of the upper portion 110 may be subject to more abrasion and other damage than the region 540 due to their location near the back of the shoe 100. For example, the regions 550*a* and 550*b* may be rubbed while a wearer puts on or takes off the shoe 100. Similarly, the regions 550*a* and 550*b* may be rubbed by the wearer's heel while the shoe 100 is worn. In some cases, as shown in FIG. 5A, the shoe 100 may include a heel lining 520 that is attached to the upper portion 110 along the interior surface 360*b* in the regions 550*a* and 550*b*. The heel lining 520 may reduce wear of the upper portion 110 and/or provide friction to retain the wearer's foot in the shoe during wear.

In some cases, the heel lining 520 is part of the upper portion 110 and has different textile properties to achieve the desired performance, including durability, similar to the reinforcement regions 310 discussed above. In some cases, the heel lining 520 is a separate component that is attached to the upper portion 110. For example, the heel lining 520 may be formed from a wear-resistant material (e.g., wool, polyester, or the like) that is attached (e.g., sewn or glued) onto the interior surface 360*b* of the upper portion 110. In some cases, the heel lining is brushed, flocked, or otherwise processed, similar to the interior surface 360*b*. The heel lining 520 may have higher abrasive strength or other improved textile characteristics compared to the upper portion 110. In some cases, the heel lining 520 covers the portion of the seam 410 on the interior surface 360*b* of the upper portion 110 to improve the comfort of the shoe. For example, the heel lining 520 may prevent the seam 410 from rubbing or otherwise irritating the wearer's foot, including a wearer wearing the shoe 100 without a sock. In some cases, the shoe 100 may include heel padding (e.g., a foam padding), for example between the heel lining 520 and the upper portion 110 to improve the comfort of the shoe.

As noted above, in some cases, the interior surface 360*b* may be processed (e.g., brushed, flocked, or the like) to achieve different textile characteristics than an exterior surface of the upper portion 110. In some cases, one or more regions of the interior surface 360*b* are brushed to soften the tactile feel of the regions. For example, the region 540 of the interior surface 360*b* may be brushed to soften the tactile feel of the region 540, for example to improve the comfort of a foot in the shoe 100. In some cases, the regions 550*a* and 550*b* are brushed in addition to the region 540. In some cases, the regions 550*a* and 550*b* are not brushed, for example if a separate heel lining 520 is installed in the regions 550*a* and 550*b*. In some cases, one or more regions of the exterior surface of the upper portion 110 are brushed. In some cases, the exterior surface of the upper portion 110 is not brushed.

In some cases, the interior surface 360*b* is brushed after the upper portion 110 is knit and before the upper portion is attached to the sole 120. For example, the appropriate regions (e.g., region 540) of the interior surface 360*b* may be brushed using a brushing machine while the upper portion 110 is in the pre-assembly configuration shown in FIG. 5B.

In some cases, the interior surface 360*b* may include different fiber types, fiber ratios, and/or yarn types compared to the exterior surface of the upper portion 110. In some cases, the knit structure may include different fiber types, fiber ratios, and/or yarn types at each surface. In some cases, as discussed above, the upper portion 110 may include different layers defining the interior surface and the exterior surface. The fiber types, fiber ratios, and/or yarn types at the exterior surface may be selected for their ability to resist abrasion and other damage, and the fiber types, fiber ratios, and/or yarn types at the exterior surface may be selected for their tactile feel (e.g., softness).

Returning to FIG. 5A, in some cases, the tongue 130 may include a wear region 530 that is more prone to abrasion and other damage than other areas of the tongue 130. In some cases, the wear region 530 may be a part of the tongue 130 having different textile characteristics than other areas of the tongue, similar to the reinforcement regions 310 discussed above. In some cases, the wear region 530 of the tongue 130 may include a separate component that is attached to the tongue 130. For example, the wear region 530 may be formed from a wear-resistant material (e.g., wool, polyester, or the like) that is attached (e.g., sewn or glued) to the tongue 130. In some cases, separate component may be attached to an exterior surface and an interior surface of the tongue 130. The wear region 530 may have higher abrasive strength or other improved textile characteristics compared to the tongue 130.

Figure 6:
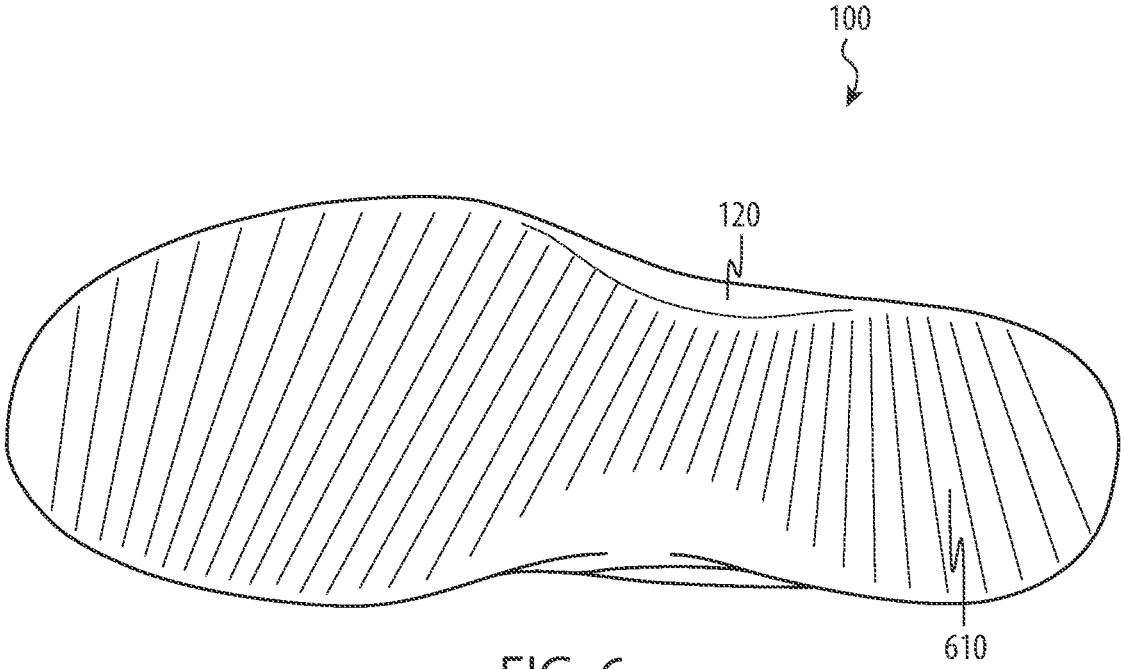
FIG. 6 illustrates a bottom view of the example shoe of FIG. 1.

As noted above, the sole 120 may define a tread surface that it adapted to contact the ground or other surfaces while the shoe is worn. FIG. 6 illustrates a bottom view of the example shoe of FIG. 1 showing an example tread surface 610 on the sole 120. The tread surface 610 may include one or more patterns or features to improve the traction of the shoe 100. In some cases, the tread surface 610 includes indentations and/or protrusions that define the patterns or features for improving traction.

In various embodiments, the sole 120 may be formed of any suitable material or combination of materials, including polyamides, polyethylene, polypropylene, polyurethane (e.g., thermoplastic polyurethane), and polyols. In some cases, the sole 120 is formed at least partially from a natural material, such as castor bean oil. As noted above, using bio-based materials may provide environmental benefits, including reduced emissions and ecological sustainability.

As noted above, many embodiments described herein reference a shoe having a knit textile upper portion. It may be appreciated, however, that this is merely one example; other configurations, implementations, and constructions are contemplated in view of the various principles and methods of operations—and reasonable alternatives thereto—described in reference to the embodiments described above.

One may appreciate that although many embodiments are disclosed above, that the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A shoe, comprising:
- a toe section;
- a sole defining a tread surface and a top surface opposite the tread surface;
- a tongue; and
- an upper portion:
  - that is attached to the top surface of the sole and defines a perimeter where the upper portion meets the sole;
  - that is attached to the tongue and defines a gap positioned over the tongue; and
  - comprising:
    - a continuous textile having a knitted structure formed at least partially from a *eucalyptus* fiber;
    - a flex region:
      - positioned in the toe section of the shoe;
      - having a first stiffness; and
      - formed from a first portion of the continuous textile;
    - a first reinforcement region:
      - extending along at least a portion of the perimeter;
      - at least partially surrounding the flex region;
      - having a second stiffness that is greater than the first stiffness; and
      - formed from a second portion of the continuous textile that is further formed from a thermoplastic material integrated with the knitted structure; and
    - a second reinforcement region:
      - that at least partially surrounds the gap;
      - having a third stiffness that is greater than the second stiffness; and
      - formed from a third portion of the continuous textile that is further formed from the thermoplastic material integrated with the knitted structure.

2. The shoe of claim 1, wherein the flex region is thinner than each of the first reinforcement region and the second reinforcement region.

3. The shoe of claim 1, wherein the knitted structure comprises:
- an outer layer defining an outer surface of the flex region, the first reinforcement region, and the second reinforcement region; and
- an inner layer defining an inner surface of the flex region, the first reinforcement region, and the second reinforcement region.

4. The shoe of claim 3, wherein:
- the inner layer of the continuous textile in each of the first reinforcement region and the second reinforcement region is thicker than the inner layer in the flex region.

5. The shoe of claim 3, wherein the thermoplastic material in the second reinforcement region is integrated with each of the inner layer and the outer layer.

6. The shoe of claim 1, wherein the shoe further comprises:
- a first set of eyelets attached to the second reinforcement region and positioned on a first side of the gap; and
- a second set of eyelets attached to the second reinforcement region and positioned on a second side of the gap.

7. A shoe, comprising a sole defining a tread surface and a top surface opposite the tread surface;

an upper portion attached to the top surface of the sole and defining a perimeter where the upper portion meets the sole, the upper portion comprising:

a continuous textile defining a gap and having a knitted structure comprising a *eucalyptus* fiber, an outer layer and an inner layer;

a flex region having a first stiffness and including a first portion of the continuous textile, the flex region comprising:

a first part defining a first area and positioned on a first side of a longitudinal axis extending from a front tip to a rear tip of the shoe; and a second part, contiguous with the first part, defining a second area that is greater than the first area and positioned on a second side of the longitudinal axis;

a first reinforcement region having a second stiffness that is greater than the first stiffness and including a second portion of the continuous textile that further comprises a thermoplastic material integrated with the knitted structure of the second portion, the first reinforcement region at least partially surrounding the flex region and extending along the perimeter in a toe section of the shoe; and a second reinforcement region having a third stiffness that is greater than the second stiffness and including a third portion of the continuous textile that further comprises the thermoplastic material integrated with the knitted structure of the third portion, the second reinforcement region at least partially surrounding the gap; and a tongue attached to the upper portion and positioned at least partially within the gap, wherein:

the outer layer of the knitted structure defines an exterior surface of the upper portion in the flex region, the first reinforcement region, and the second reinforcement region; and the inner layer of the knitted structure defines an interior surface of the upper portion in the flex region, the first reinforcement region, and the second reinforcement region.

8. The shoe of claim 7, wherein:

a first part of the first reinforcement region is positioned on the first side of the longitudinal axis and is configured to be positioned over at least a portion of a big toe of a wearer; and a second part of the first reinforcement region is positioned on the second side of the longitudinal axis and extends to a lesser extent from the perimeter than the first part.

9. The shoe of claim 8, wherein the flex region defines a stepped shape.

10. The shoe of claim 7, wherein a rear width of the first part of the flex region is less than a rear width of the second part of the flex region.

11. The shoe of claim 7, wherein the first reinforcement region is thicker than the flex region.

12. The shoe of claim 11, wherein the inner layer has a greater thickness in the first reinforcement region than in the flex region.

13. The shoe of claim 12, wherein the outer layer has a greater thickness in the first reinforcement region than in the flex region.

14. The shoe of claim 7, wherein:

the first portion of the continuous textile in the flex region comprises a yarn including the *eucalyptus* fiber; and the second portion of the continuous textile in the first reinforcement region comprises the yarn including the *eucalyptus* fiber and the thermoplastic material.

15. A shoe, comprising:

a sole defining a tread surface and a top surface opposite the tread surface; and an upper portion attached to the top surface of the sole and defining a perimeter where the upper portion meets the sole, the upper portion comprising:

a continuous knitted structure defining an outer layer and an inner layer, the continuous knitted structure including a yarn comprising a *eucalyptus* fiber;

a flex region positioned in a toe section of the shoe, having a first density, and including a first portion of the continuous knitted structure, and a reinforcement region at least partially surrounding the flex region, having a second density that is greater than the first density, and including a second portion of the continuous knitted structure that has an inner layer thickness that is greater than an outer layer thickness.

16. The shoe of claim 15, wherein the inner layer in the reinforcement region includes an additional yarn as compared to the inner layer in the flex region and the additional yarn is a second yarn comprising the *eucalyptus* fiber.

17. The shoe of claim 16, wherein the inner layer in each of the reinforcement region and the flex region further comprises a third yarn comprising nylon and spandex.

18. The shoe of claim 15, wherein the inner layer is interlaced with the outer layer.

19. The shoe of claim 18, wherein the reinforcement region further comprises a thermoplastic material absorbed into the continuous knitted structure.

* * * * *